US007250849B2

(12) United States Patent
Spriggs et al.

(10) Patent No.: US 7,250,849 B2
(45) Date of Patent: Jul. 31, 2007

(54) DETECTION OF UNDESIRED OBJECTS ON SURFACES

(75) Inventors: Timothy John Spriggs, Hampshire (GB); Bryan Stephen Rickett, Romsey (GB); Richard John Evans, Winchester (GB); Andrew David Chadwick, Southampton (GB)

(73) Assignee: Roke Manor Research Limited, Romsey (GB)

( * ) Notice: Subject to any disclaimer, the term of this patent is extended or adjusted under 35 U.S.C. 154(b) by 320 days.

(21) Appl. No.: 10/494,271

(22) PCT Filed: Nov. 21, 2002

(86) PCT No.: PCT/GB02/05258

§ 371 (c)(1),
(2), (4) Date: Nov. 12, 2004

(87) PCT Pub. No.: WO03/046290

PCT Pub. Date: Jun. 5, 2003

(65) Prior Publication Data

US 2005/0046569 A1 Mar. 3, 2005

(30) Foreign Application Priority Data

Nov. 21, 2001 (GB) ..... 0127904.1

(51) Int. Cl.
*B60Q 1/00* (2006.01)

(52) U.S. Cl. ..... 340/435; 340/904; 244/114 R; 701/301

(58) Field of Classification Search ..... 340/435, 340/904; 244/114 R; 701/301
See application file for complete search history.

(56) References Cited

U.S. PATENT DOCUMENTS

| | | | | |
|---|---|---|---|---|
| 4,621,562 | A * | 11/1986 | Carr et al. | 89/41.05 |
| 4,623,032 | A * | 11/1986 | Kemmer | 340/904 |
| 5,067,115 | A | 11/1991 | Wada | |
| 5,936,240 | A * | 8/1999 | Dudar et al. | 250/253 |
| 6,181,261 | B1 | 1/2001 | Miles et al. | |
| 6,459,955 | B1 * | 10/2002 | Bartsch et al. | 700/245 |
| 6,763,282 | B2 * | 7/2004 | Glenn et al. | 700/245 |
| 7,066,291 | B2 * | 6/2006 | Martins et al. | 180/167 |

FOREIGN PATENT DOCUMENTS

EP 0952460 10/1999

(Continued)

OTHER PUBLICATIONS

"J. Spriggs: "Runway Safety" Technologies for Debris Detection" 'Online! XP002230491 Feb. 10, 2003.

*Primary Examiner*—Jeffery Hofsass
*Assistant Examiner*—Samuel J. Walk
(74) *Attorney, Agent, or Firm*—Crowell & Moring LLP

(57) ABSTRACT

A device for detection of undesired objects on surfaces, for example airport runways co-ordinates sensed data from a plurality of sensor units. With radar sensors, synthetic aperture radar processing is found to be advantageous. A vehicle which is configured with a plurality of sensors may be either remotely controlled or autonomous. It may also be provided with communication equipment and debris retrieval apparatus and that includes both mobile sensing devices and fixed installations. A suitable mobile sensing device and a method for operating the debris detection system are also provided.

21 Claims, 3 Drawing Sheets

FOREIGN PATENT DOCUMENTS

| | | |
|---|---|---|
| GB | 2157436 | 10/1985 |
| GB | 2313190 | 11/1997 |
| GB | 2358269 | 7/2001 |
| GB | 2369511 | 5/2002 |
| WO | WO 00/78410 | 12/2000 |
| WO | WO 02/101411 | 12/2002 |
| WO | WO 03/046290 | 6/2003 |

* cited by examiner

DETECTION OF UNDESIRED OBJECTS ON SURFACES

The present invention relates to a method and apparatus for detecting the presence of undesired objects on surfaces. In particular the present invention relates to airport runway debris detection.

BACKGROUND OF THE INVENTION

The known technologies available for debris detection in the airport environment have been examined and areas for improvement identified. It has been found that a novel mobile sensing technique is highly appropriate for this application in the long term.

Much of the following discussion focuses upon runway applications. It is, however, noted that the present invention may also be deployed in other locations where surface obstruction or contamination may be a problem. Embodiments of the present invention may also be applied to the detection of undesired objects on roads and major highways; in shipping lanes and at the dock-side; and even in factories. As will be apparent, the consequences of the presence of undesired objects on airport runways can be exceptionally severe thus there is a particular need to address runway applications.

Undesired object damage due to debris on the pavement can occur anywhere in the aircraft maneuvering or movement areas of an airport. Damage can be caused by jet blast from one aircraft blowing debris onto another, or onto people, or onto logistics and infrastructure items. Damage can also occur directly to an aircraft striking the debris.

A major event in which an aircraft sustains significant damage can cause delay or cancellation of its flight, with the consequent knock-on effects of re-scheduling, increased workloads for airport and airline personnel, and loss of customer satisfaction. The major costs will be those of repairs and third-party liability claims. If debris is ingested by a jet engine, repair costs can rise to millions of Euro.

On an active runway, the consequence of a undesired object damage event can be more severe due to the higher kinetic energies involved; it can even lead to loss of the aircraft, and consequent loss of life. Take-off accidents are likely to be particularly severe due to the large fuel load. Such an event is likely to result in closure of the airport for a significant period, causing knock-on effects throughout the Air Navigation System of the region, which may increase the likelihood of further accidents elsewhere.

There are documented examples of catastrophic aircraft losses due to both non-metallic and metallic objects on a runway.

Debris on the runway can come from jet blast effects; for example, an aircraft turning from the active runway onto a narrow taxiway can blow material from the shoulders and in-field areas backwards on to the runway. Items may also fall from the aircraft themselves, or other vehicles, causing a hazard for subsequent users of the runway. In addition, other undesired objects need to be detected on the runway and in other active areas: examples of these undesired objects include misplaced tools, rubbish and even animals.

The current approach to this problem is for someone to physically go out onto the runway and look. This is usually done in a vehicle such as a Land Rover, which has to be in radio contact with the ground and air traffic controllers to co-ordinate runway occupancy with aircraft movements. At a busy airport, the debris monitoring operation will tend to be continuously interrupted by aircraft operations; it may even constitute a constraint to runway capacity.

It is apparent therefore, that a need exists for an automated debris sensor system.

Where it is known to use a radiometer to detect vehicles against a road surface (see UK patent application, Pub. No. GB 2358269), recent work has shown that it would also be practicable to employ radiometers to detect recently deposited debris that is out of thermal equilibrium with the runway. Particularly good results will also be obtained from metallic objects that reflect the sky temperature to the sensor.

The use of millimeter wave radar is also known for the detection of small objects on the ground, but the results are severely limited due to the clutter returns, it has been found that better results are obtained when synthetic aperture radar processing is employed. Synthetic aperture radar using the focused processing method can be mounted on a rail adjacent to the area to be monitored and be arranged to run backwards and forwards in a controlled manner. Alternatively, unfocussed synthetic aperture processing can be employed to give reasonable results from a sensor mounted on a vehicle, whose motion is less predictable.

Sensors all have their strengths and weaknesses in this application; a camera system, for example, may interpret a skid mark on the runway as a piece of flat debris, radar is unlikely to see it at all. Conversely, a radar system may get a strong signal echo from a small piece of metal foil that would not be a hazard, and which a camera would not see. Combining the data from diverse sensors will give a better overall result and reduce false alarms.

Three main strategies for deployment of sensors can be adopted. In a first strategy, a high number of fixed installations can be used in order to get short-range coverage of the entire surface of interest; in a second, a mobile system can be used, the system mirroring that being used at present, viz. inspection Land Rovers, in this way the sensors are moved close to the observation areas over time; and finally these fixed and mobile systems can be combined, whereby the fixed sensors could continuously monitor the regions of highest risk while the mobile system can patrol the remaining active areas.

The current inspection vehicles operate on busy runways and can take up to forty-five minutes per sweep; these sweeps are carried out relatively infrequently during the day. It is clear that the mobile system carrying sensors should be more vigilant and provide higher coverage rates than the existing approach.

SUMMARY OF THE INVENTION

It is therefore an object of the invention to obviate or at least mitigate the aforementioned problems.

Some of the research which led to the present invention is described in Roke Manor Research Ltd's report 72/01/R/146/U, "Airport Runway Debris Study", made available to the public after the priority date of this application at www.eurocontrol.int/care/innovative/studies/rokemanor/rokemanor.htm.

In accordance with one aspect of the present invention, there is provided a vehicle carrying one or more sensors for the detection of undesired objects and debris on paved and other relatively smooth areas.

The data collected by the vehicle may be employed to provide an alarm if an undesired object or piece of debris is detected.

The data collected by the vehicle may also be employed to provide an estimate of the location of an undesired object or piece of debris that is detected.

The vehicle may have onboard data processing that reduces the bandwidth required for communication with off-vehicle systems.

The vehicle preferably communicates with other systems using a mobile telecommunications system. The mobile telecommunications system may be GSM or 3G, for example. Wireless networks could also be used.

Advantageously, the vehicle monitors active areas of an airport. The active areas including movement and/or maneuvering areas.

The vehicle may use stealth technology to minimize the interference caused to other essential equipment operating nearby. The other essential equipment preferably including aircraft landing systems.

The vehicle may be equipped to operate autonomously.

The autonomous vehicle may be constrained to operate within an area defined by an external means. The external means including a rail, buried conductors, features of the external environment of the vehicle, or a precise navigation system.

Advantageously, the vehicle may be equipped so as to go and pick up the detected object and remove it from the monitored area. For example, the vehicle may be provided with a robot arm, remotely controlled by a human operator who observes the object and the robot arm by use of a video camera carried on the vehicle.

In accordance with a further aspect of the present invention, there is provided a detector system combining the data from a plurality of sensors, said sensors being provided in at least one fixed installation and at least one mobile sensor apparatus, thereby reducing the likelihood of false alarms.

At least one sensor may be a synthetic-aperture radar.

At least one of the sensors may be a radiometer.

At least one of the sensors may be a camera. The camera may be a stereo camera set.

At least one of the sensors may be a radar transceiver. The radar transceiver may be a conventional transceiver or a multi-static radar transceiver.

At least one of the sensors may be an ultrasonic detector device. Ultrasonic devices may operate in an analogous fashion to radar detectors.

At least one of the sensors may sense reflection of laser light. Said sensor may be a lidar device or a scanning laser device.

At least one of the sensors provided in a fixed installation may be a synthetic aperture radar device, constrained to run along a track or rail adjacent to the area to be observed.

More particularly, the present invention provides apparatus for detecting the presence of undesired objects on the surface of a monitored area comprising a mobile vehicle. The vehicle carries one or more sensors for the detection of undesired objects, is equipped for autonomous operation within a predetermined area, and is constrained to operate within the predetermined area by external means.

The vehicle may further comprise means for generating an alarm in response to the detection of a undesired object; and/or means for estimating the location of a detected undesired object; and/or telecommunications equipment for transmitting signals in response to the detection of a undesired object.

In this latter case, the telecommunications equipment may operate according to standards defined for mobile telephony; alternatively according to wireless network standards.

The signals may include a representation of the estimated location of the undesired object.

The apparatus may be equipped with an optical camera arranged to be responsive to certain predetermined artifacts of the external means, thereby enabling the vehicle to maintain its position within the predetermined area. The optical camera may be arranged to be responsive to artifacts representing a transition between grass and paved surfaces; or alternatively to artifacts representing suitably positioned binary acquisition targets.

The apparatus may be constrained to operate within the predetermined area by mechanical means such as one or more rail(s).

The apparatus may be constrained to operate within the predetermined area by operation in response to location-sensitive circuitry within the vehicle. The circuitry may contain a sensor responsive to the proximity of a conductor buried under a surface hereupon the vehicle is arranged to move. The circuitry may comprise a navigation system such as a satellite guided location system.

The apparatus may be further equipped with on-board data processing equipment (12).

The apparatus may be further equipped to remove a detected undesired object from the monitored area.

The apparatus may be further equipped so as to minimize interference with other equipment such as aircraft landing systems.

The present invention also provides a system for the detection of undesired objects on the surface of a monitored area comprising at least two sensors, at least one of said sensors being fixed in a stationary position to monitor a part of the monitored area, and at least one further of said sensors being attached to a mobile sensor apparatus.

Each sensor may be arranged to provide an output signal indicative of the detection of an artifact resembling a undesired object, further comprising means for directing a plurality of the sensors to inspect the region of the detected artifact, thereby to provide validation of the detection of a undesired object.

At least one of the described sensors may comprise at least one of the following set of types of sensor: a synthetic-aperture radar; a radio meter; a camera; a stereo camera set; a radar transceiver; a multi-static radar transceiver; an ultrasonic detector device; a light sensor; a lidar device; a scanning laser device.

The system or apparatus may comprise a synthetic aperture radar as a sensor, and may be constrained to run along a track or rail adjacent to the monitored area.

Other objects, advantages and novel features of the present invention will become apparent from the following detailed description of the invention when considered in conjunction with the accompanying drawings.

The advantage of fitting a plurality of different sensors to a remote autonomous vehicle include: short range operation, allowing optimized sensor performance; continuous coverage of the runway area, there will be no time period when some part of the runway is not being surveyed; replacement of potentially fallible human operative; increased safety, the small size and stealth characteristics of the vehicle make it safer and less of a hazard than conventional inspection vehicles; and ease of deployment, the system is easy to install and deploy as it requires no infrastructure changes to the airfield active area.

Figure 3A:
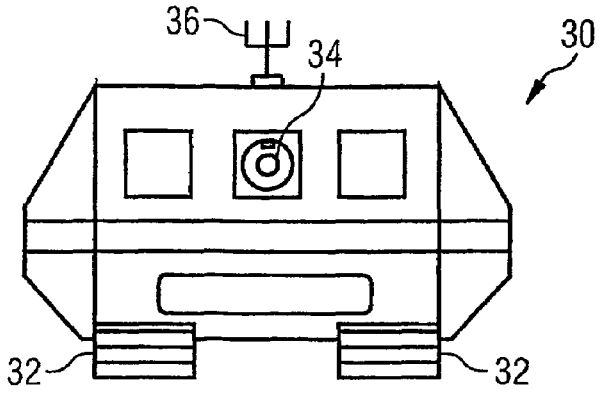
FIGS. 3A-3C show an autonomous vehicle according to an embodiment of the present invention.
Figure 3B:
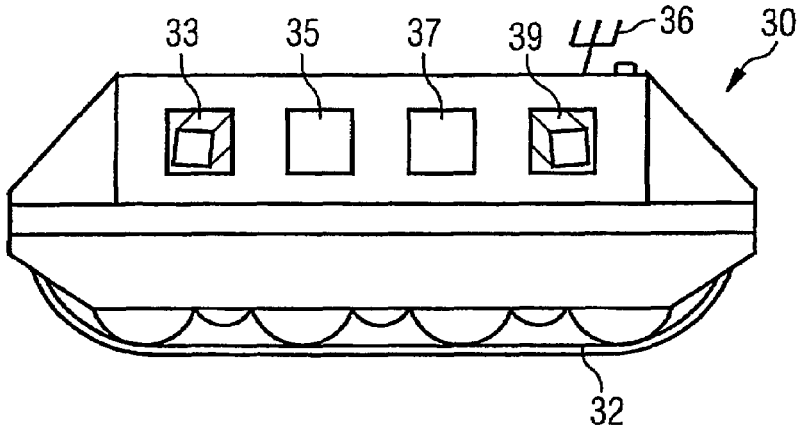
Figure 3C:
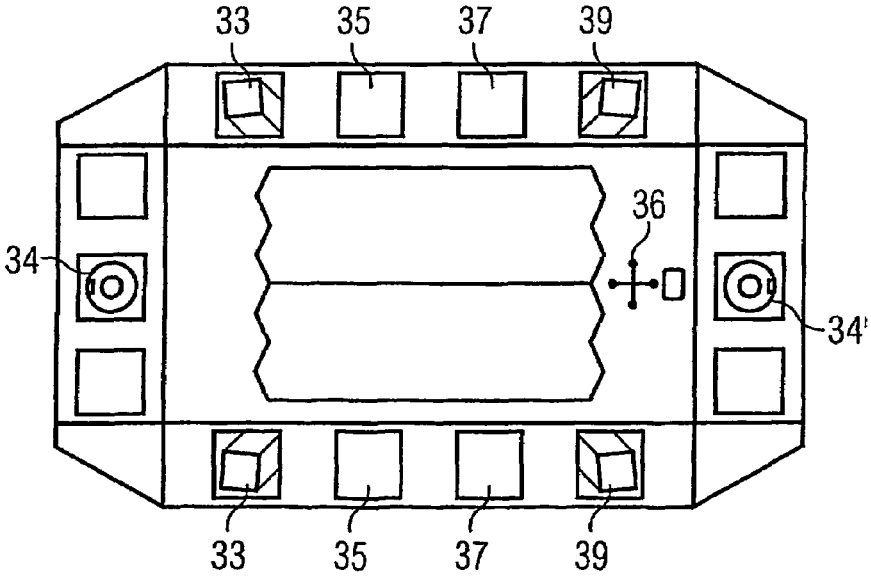

FIGS. 3A-3C illustrate one embodiment of the present invention, a self-powered vehicle 30 which may be used to inspect a runway. The vehicle is designed to be small enough to fit within the legislative requirements for equipment close to operational runways, for example the vehicle 30 may not be more than nine hundred millimeters high. The vehicle in this embodiment has tracks 32 in order to make it an all-terrain vehicle similar to the vehicles used by bomb disposal teams.

The vehicle 30 is equipped with at least one sensor. In the illustrated embodiment, the vehicle carries debris-detecting cameras 33, 39; a radiometer 35, and radar 37. As illustrated in FIG. 3C, corresponding sensors may be provided on opposite sides of the vehicle. Alternatively, if the vehicle is operated at the side of a runway, or the like, and only needs to sense debris on one side, the sensors 33, 35, 37, 39 may only be provided on one side. Of course, other sensors may be used, or only some of the sensors illustrated may be provided in any particular embodiment. The vehicle is also provided with navigation equipment, enabling it to receive information from the external means which constrain it to operate within a predetermined area. In the case illustrated in FIGS. 3A-3C, one or more optical camera 34, 34' is provided, for detecting features of the external environment of the vehicle, for example, a line drawn on the ground; a transition between grass and paved surfaces; or binary acquisition targets provided for the purpose. The vehicle also comprises a communications device, for the example using radio antenna 36 to communicate with an operator.

The tracked vehicle can operate in the grass on the side of a runway but ideally would operate on the pavement at the edge of the runway shoulder. The purpose of the low profile configuration is to allow the vehicle to operate in close proximity to the normal air traffic without introducing any additional safety hazards. Ideally the vehicle is arranged to be relatively stealthy that is, to be relatively non-reflective to ground radar and similar electromagnetic radiation, so as to avoid interfering with instrument landing systems or other navigational aids.

Clearly the system requires communications to the operations personnel such as the control tower at an airport, with the ability to transmit camera images and relatively small amounts of data. The images may be freeze-framed or otherwise processed in order to minimize the bandwidth required. More details of image processing techniques may be found in UK patent application, Pub. No. GB 2222338. Current GSM and third generation (3G) mobile telephone systems are an obvious choice for communications schemes. One reason for the preferred use of mobile telephony systems for communication between the vehicle and the operator is to avoid further loading airport VHF communications channels, which are capacity limited. The vehicle is preferably also remote-controllable, for example by means of a via radio data link from the operator to the vehicle. This enables the issuance of clearances onto the runway and allows manual control in the event of emergency or when a better view of the debris is required.

The vehicle 30 can be arranged to be autonomous and to operate within a predetermined area, for example along a predefined linear track, defined by external means. For example, the vehicle may use a vision system employing cameras 34, 34' to guide itself along an interface between runway and grass. Autonomous use and guidance is further discussed in UK patent applications, Pub. Nos. GB 2218507 and GB 2246261. Alternatively, the vehicle can be arranged to be autonomous and to use such a vision system to guide itself with respect to suitably positioned binary acquisition targets, for example a simple black and white pattern that will not be found elsewhere in the vehicle's environment. A suitable system using binary acquisition targets is discussed in European patent application, Pub. No. EP 0672389.

Additionally or alternatively the vehicle may be controlled by other types of external means such as rails or buried wire based guidance systems to constrain its operation to particular, pre-defined areas.

The vehicle 30 is preferably provided with a plurality of different types of sensor required for debris detection. The plurality of sensors preferably include: a camera 33, 39, possibly accompanied by an associated illumination source; a radar sensor arrangement with synthetic aperture processing; and a radiometer, for finding metallic objects. In at least one example the camera operates in the infra-red band in order to avoid lights which might prove distracting for pilots. Each of the sensors provides information gathered to a processor within the vehicle. The information gathered by each sensor may be arranged to conform to a standard report structure or may be reported in a sensor specific format. In either scenario the processing means is suitably arranged to be able to process information reported.

The vehicle includes a guidance system for guiding the vehicle autonomously. In one example the guidance system steers the vehicle using the transition from pavement to grass and thereby enables the vehicle to remain off the actual hard surface. The vehicle preferably reports its location regularly to the operator in order to provide a safety check and to inform ground movement and air traffic controllers of its position.

The movement pattern adopted by any mobile system can be crucial to successful detection. The vehicle may simply move alongside the runway and then stop during active flights. As such it would only be in motion when no aircraft were using the runway. In this way it may not violate any of the existing safety legislation relating to runways.

In an alternative embodiment, the vehicle proceeds, continuously scanning the runway even while active flights are using the runway. This would be dependent on determining that the vehicle could never actually enter onto the runway or any of the taxiways or maneuvering areas, and would probably require the use of a physical restraint, such as rails to constrain the motion of the vehicle.

In a further embodiment, the vehicle 30 may be equipped to clear the runway of debris and sweep the runway surface. Upon detection of an undesired object on the runway, the operator would stop all aircraft traffic on the runway. The vehicle, under remote control, would enter onto the runway. The debris items would be collected and carried away from the runway by suitable equipment provided to the vehicle 30 before operations resumed. In operation, the vehicle 30 may be constrained to move slowly along the sides of the runway and apron areas. A number of similar vehicles may be provided to survey an entire airport including all active areas. A pair of vehicles may be slaved to one another to monitor for debris from either side of a runway.

In certain embodiments of the invention, the vehicle is arranged to stop whenever f any one of the sensors produces a suspicious return. The remaining sensors on board are then also used to try to validate the detection. Certain types of debris are more visible to certain types of sensor. Conversely, different types of sensor are susceptible to different types of false alarm. By applying numerous sensors to a suspicious return, the operator can have more confidence in classifying a suspicious return as significant or as a false alarm. The camera is used to zoom to the suspected position and then the operator is alerted. The operator will see the camera view remotely and be able to control the vehicle and camera in order to make closer inspections remotely. There will be the ability to change position to improve the detection geometry. If the operator suspects that debris has been found then he can stop use of that area of the airport and initiate collection of the item. Initially collection will be by human operatives but as confidence is built in the present system, collection can be remote controlled or even autonomous, thereby requiring less operator intervention.

Figure 1:
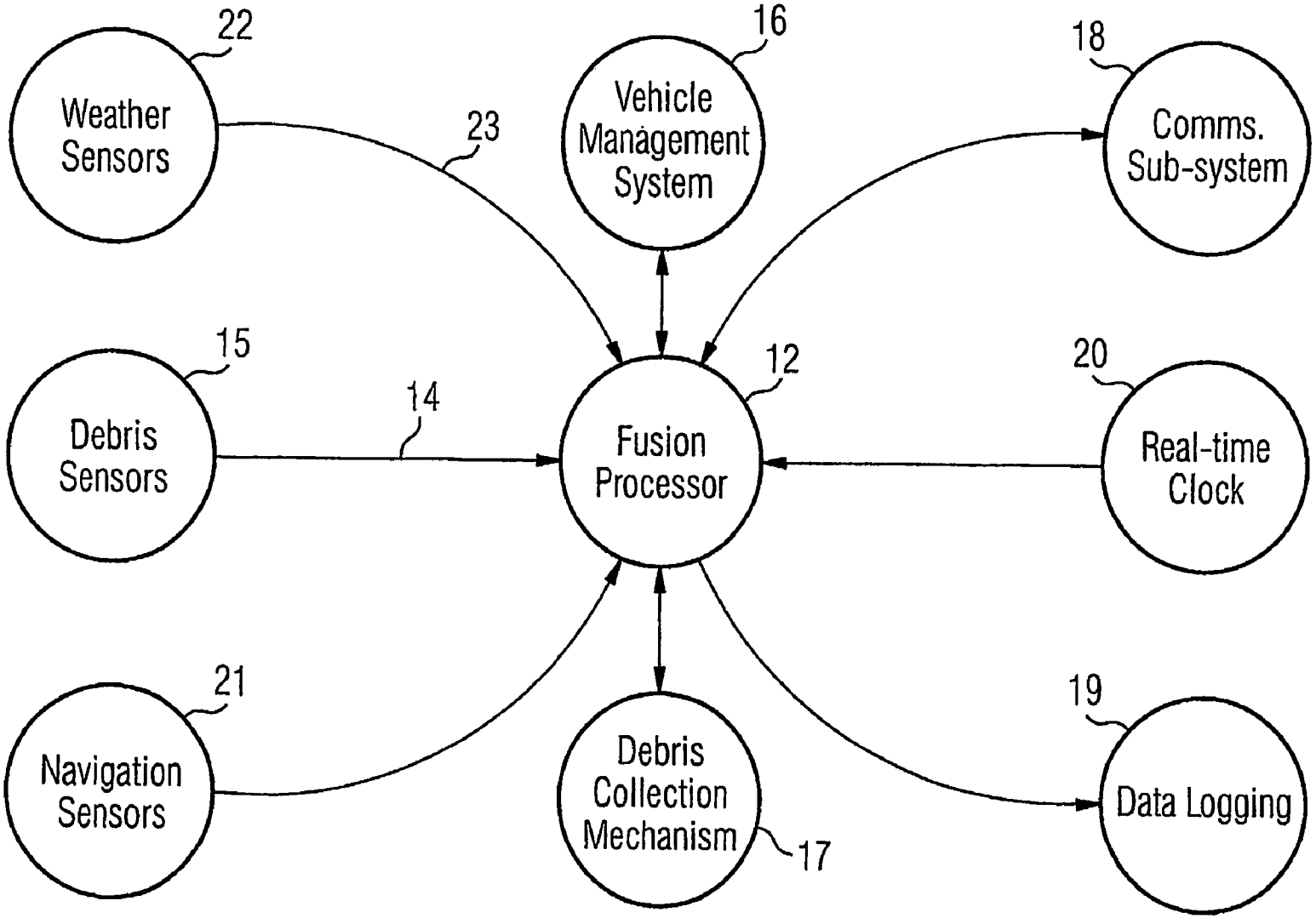
FIG. 1 shows a functional block diagram of a mobile system according to the present invention.

The operational structure of a mobile debris detection apparatus according to the present invention is illustrated in FIG. 1. At the heart of all activity is a processor 12. The processor 12 co-ordinates and controls the processing of data 14 gathered by the debris sensor(s) of the vehicle, which sensors may be of different types. In addition the processor 12 governs: vehicle management system 16, which manages tasks allowing motion of the vehicle 30; debris collection arrangement 17, if any communications sub-system 18; and also controls the recording of data upon a storage medium 19, such as RAM or permanent memory.

The processor may be a single processor provided upon a single circuit board and processing all data, but equally may comprise a plurality of dedicated processing devices distributed across the system of the invention. In the majority of cases the processor will be at least in part a digital device and will require pulse-train clock signals to regulate the passage of data through the system. Furthermore, a real-time clock 20 is provided. This supplies time-of-day, and preferably also day/date information to enable any detections made by the sensors to be identified by the exact time at which they are made. By accurately identifying each sensor detection by time, it is possible to more readily identify those detections that relate to the same piece of debris, for example.

The processor 12 may be termed a fusion processor in recognition of its main signal processing task, being to fuse sensor detections and thereby to provide a more robust debris detection system.

The system of the present invention is preferably also provided with at least one navigation sensor 21, providing processor 12 with information either in the form of absolute position—for example, derived from a GPS receiver—or relative position—for example, as derived from a video image of the system's immediate surroundings.

In certain embodiments of the present invention, at least one weather sensor 22 is provided. This supplies weather-related data 23 to the processor 12. Processor 12 may use this information to interpret the readings from debris sensors, or may simply provide information to the operator. For example, a general darkening of the image seen by the camera may cause a suspicious return. However, if this general darkening is combined with the onset of rain, or a reduction in sunlight—for example due to a cloud passing in front of the sun—then the suspicious return may be ignored, or at least investigated further before being reported to the operator. Similarly, a general lightening of the image may be disregarded if combined with weather sensor data indicating the onset of precipitation, in combination with an air temperature of below 0° C. Weather sensors may also assist in interpretation of features appearing in the image. For example, a scattering of small objects that suddenly appear across the surface under examination may indicate a dangerous spillage of gravel. With the addition of a rain sensor, the system of the present invention may be able to eliminate such features if their appearance corresponds with the onset of rain, or may at least inform the user that rain is detected, allowing the user to make the decision as to whether the detected features are significant or not.

Figure 2:
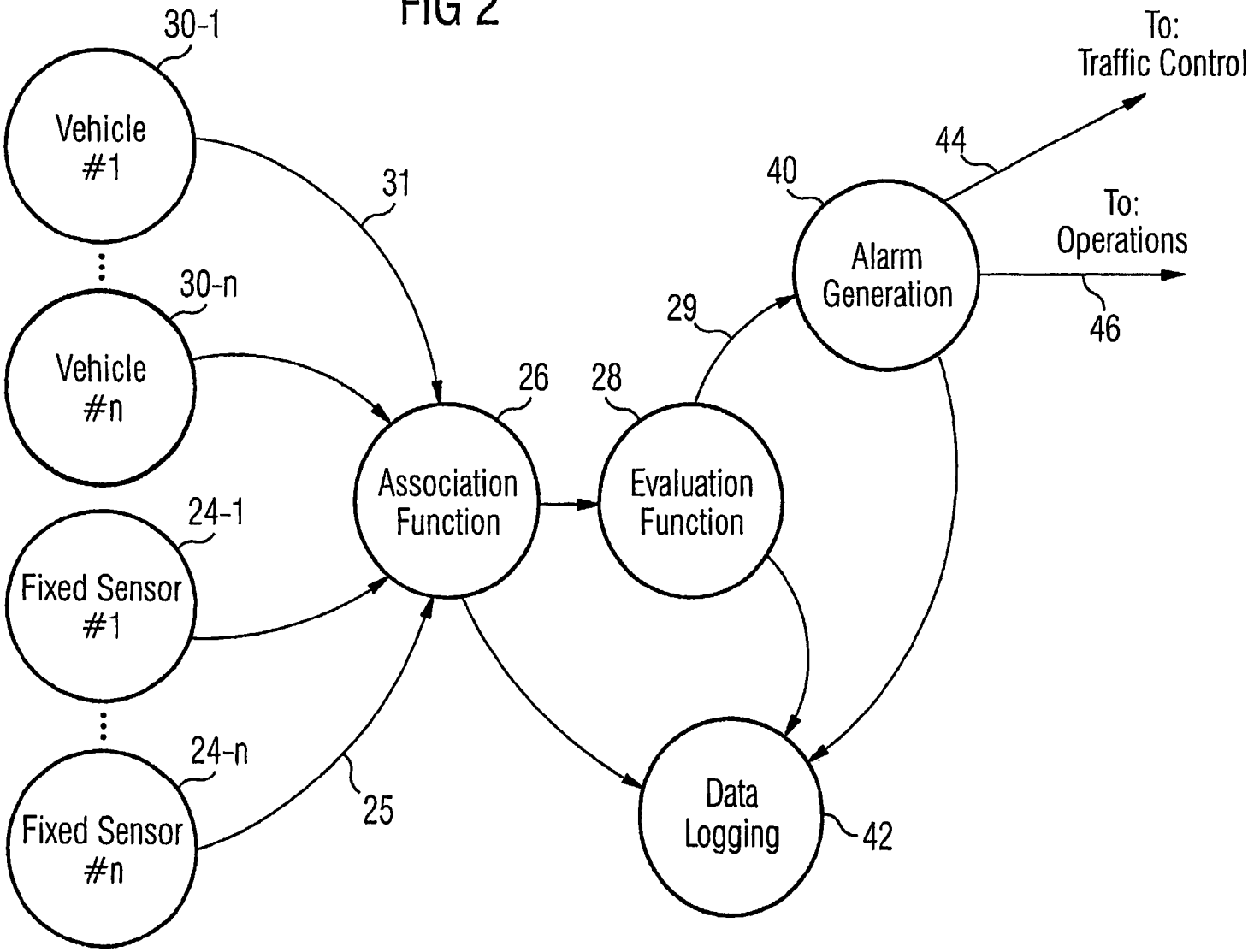
FIG. 2 shows a simplified high level system diagram of a combined undesired object sensor system including mobile sensor vehicles and fixed installations.

FIG. 2 shows an airport debris detection system according to an embodiment of the present invention. A plurality of detection vehicles 30-1 to 30-n are employed, in conjunction with a plurality of fixed, that is to say immobile, sensor arrangements 24-1 to 24-n. Each of the detection vehicles 30-1 to 30-n embodies a mobile debris detection system in accordance with an embodiment of the present invention, for example as illustrated in FIGS. 3A-3C. The fixed sensor arrangements 24 preferably include a plurality of different types of sensor device, each sensor device being coordinated with the remaining sensors to locate and subsequently to confirm the presence of a undesired object within range of the sensors.

Data gathered by each detector vehicle 30 and each fixed sensor arrangement 24 is collated and processed by an association function 26, typically provided by a processor such as a digital computer arranged to receive data 31 transmitted by the vehicles 30, and data 25 sent by the fixed sensor arrangements 24. When a potentially hazardous undesired object is indicated by one sensor belonging to one of the vehicles and/or one of the fixed sensors, the remaining available sensors will be trained upon the target object. Alternatively, a more elegant, and faster, solution is for the association function to review data from all the sensors and, using time data and position estimates from each sensor, associate those that apparently arise from a same object. Each sensor will then only report the features detected in its own range, with no control being applied to direct the sensors in any new direction. The data from each sensor may then be combined to reach a decision on whether the detected object is in fact a hazard. The combination of data from numerous sensors reduces the risk of false alarm. A human operator may intervene at this point to verify the system's interpretation. The association function 26 collates the information received from the vehicles 30 and fixed sensors 24, and provides the collated information to an evaluation function 28. The evaluation function 28 compares outputs from the various fixed sensors and vehicles, to determine whether a detected artifact is a genuine hazard, a non-hazardous object (e.g. a small puddle of water) or a false alarm (e.g. an artifact of the sensor). If a detected artifact is confirmed to be a hazard, signals 29 are sent to an alarm generation unit 40. The location and corresponding sensor readings related to the detection of the confirmed hazard are supplied by the association function 26 and the evaluation function 28 and are logged by storage in a data logging device 42, typically a digital memory, and preferably a permanent, non erasable memory. The data relating to the confirmed hazard may be presented 44, 46 to a human controller. For example, the alarm generation unit may trigger alarms in both air traffic control 44 and operations rooms 46 of an airport thereby giving warning of the need to prevent use of that area of the airport until the detected undesired object is removed.

The object may be removed by human operatives or by a mobile sensor vehicle 30 equipped with a suitable debris collection arrangement.

As indicated previously the present invention is not limited to the airport debris detection embodiment disclosed above. On the contrary, the present invention is readily adapted to the detection of undesired objects on highways, in harbors and ports and in factory assembly lines.

In a further embodiment of the present invention, similar mobile sensor vehicles can be arranged to run on a rail at the track side of a motor racing circuit. Synthetic aperture radar sensors on the vehicle may detect debris, metallic objects in particular, and any potential hazard detected may be confirmed by a camera system, such as a stereo camera system. In the event of a positive detection of a hazard, steps can be taken to prevent accidents to racing cars and bystanders which may be caused by undesired objects including car parts, misplaced tools and displaced masonry.

While the present invention has been described by reference to a limited number of specific embodiments, numerous variations are possible, within the scope of the invention as defined in the appended claims. The sensors employed in the vehicles and/or fixed sensor units may include any of: a camera system, which may be a stereo camera system; a radiometer; a millimeter wave radar; an ultrasonic sensor. Indeed, any type of sensor which is capable, either alone or in consort with another, of detecting artifacts representing undesired objects of interest may be used.

Many of the methods and apparatus described with reference to FIGS. 1 and 2 may be embodied in a programmable general purpose digital computer. The terms "apparatus" and "means" as used herein should accordingly be interpreted to include not only application-specific devices intended solely for the purpose of the present invention, but also to include corresponding hardware and/or software parts of a general purpose machine, such as a digital computer.

This invention claimed is:

1. Apparatus for detecting the presence of undesired objects on the surface of a monitored area, said apparatus comprising:

a mobile vehicle carrying one or more sensors for the detection of undesired objects; and an external constraining means; wherein, the vehicle is equipped for autonomous operation within a predetermined operating area;

the external constraining means constrains the vehicle to operate within the predetermined operating area; and the predetermined operating area is situated outside the monitored area.

2. Apparatus according to claim 1, further comprising means for generating an alarm in response to the detection of an undesired object.

3. Apparatus according to claim 1, further comprising means for estimating the location of a detected undesired object.

4. Apparatus according to claim 1, further comprising telecommunications equipment for transmitting signals in response to the detection of a undesired object.

5. Apparatus according to claim 4, wherein the telecommunications equipment operates according to standards defined for mobile telephony.

6. Apparatus according to claim 4, wherein the telecommunications equipment operates according to wireless network standards.

7. Apparatus according to claim 5, wherein the signals include a representation of the estimated location of the undesired object.

8. Apparatus according to claim 1, equipped with an optical camera arranged to be responsive to certain predetermined artifacts of the external means, thereby enabling the vehicle to maintain its position within the predetermined area.

9. Apparatus according to claim 7, wherein the optical camera is arranged to be responsive to artifacts representing a transition between grass and paved surfaces.

10. Apparatus according to claim 7, wherein the optical camera is arranged to be responsive to artifacts representing suitably positioned binary acquisition targets.

11. Apparatus according to claim 1, wherein the external constraining means comprises mechanical means such as one or more rail(s).

12. Apparatus according to claim 1, wherein the vehicle is constrained to operate within the predetermined area by operation in response to location-sensitive circuitry within the vehicle.

13. Apparatus according to claim 12, wherein the circuitry contains a sensor responsive to the proximity of a conductor buried under a surface whereupon the vehicle is arranged to move.

14. Apparatus according to claim 12, wherein the circuitry comprises a navigation system such as a satellite guided location system.

15. Apparatus according to claim 1, further equipped with on-board data processing equipment.

16. Apparatus according to claim 1, further equipped to remove a detected undesired object from the monitored area.

17. Apparatus according to claim 1, equipped so as to minimize interference with other equipment such as aircraft landing systems.

18. A system for the detection of undesired objects on the surface of a monitored area comprising at least two sensors, at least one of said sensors being fixed in a stationary position to monitor a part of the monitored area, and at least one further of said sensors being attached to a mobile sensor apparatus as defined in claim 1.

19. A system according to claim 18, wherein each sensor is arranged to provide an output signal indicative of the detection of an artifact resembling an undesired object, further comprising means for directing a plurality of the sensors to inspect the region of the detected artifact, thereby to provide validation of the detection of a undesired object.

20. Apparatus or a system according to claim 1, wherein at least one sensor comprises at least one of the following set of types of sensor: a synthetic-aperture radar; a radio meter; a camera; a stereo camera set; a radar transceiver; a multistatic radar transceiver; an ultrasonic detector device; a light sensor; a lidar device; a scanning laser device.

21. A system or apparatus according to claim 1, comprising a synthetic aperture radar as a sensor, and constrained to run along a track or rail adjacent to the monitored area.

* * * * *